US005526968A

United States Patent [19]

Larson

[11] Patent Number: 5,526,968

[45] Date of Patent: Jun. 18, 1996

[54] HANGER VALET

[76] Inventor: James A. Larson, 13831 Echo Park La., Burnsville, Minn. 55337

[21] Appl. No.: 285,176

[22] Filed: Aug. 3, 1994

[51] Int. Cl.[6] ..... A41D 27/22; G09F 3/00; G09F 9/00

[52] U.S. Cl. ..... 223/88; 223/85; 223/DIG. 1; 223/92; 40/322; 116/323

[58] Field of Search ..... 223/85, 88, 92, 223/87, 98, DIG. 1; 40/322; 116/306, 307, 321, 322, 323

[56] References Cited

U.S. PATENT DOCUMENTS

| | | | |
|---|---|---|---|
| D. 140,338 | 2/1945 | Hill | 248/317 |
| D. 204,342 | 4/1966 | Larkin | 223/85 |
| 1,458,100 | 6/1923 | Knopf | 116/321 |
| 1,530,857 | 3/1925 | Settle | 223/92 |
| 1,546,609 | 7/1925 | Scheinman | 223/92 |
| 2,492,226 | 12/1949 | Kohl et al. | 223/88 |
| 2,827,872 | 3/1958 | Thoma | 116/323 |
| 3,124,284 | 3/1964 | Collum | 40/322 |
| 3,378,180 | 4/1968 | Singer | 223/88 |
| 3,592,343 | 7/1971 | Swett | 223/88 |
| 3,705,653 | 12/1972 | Pereyra | 211/13 |
| 3,783,995 | 1/1974 | Tobin | 223/DIG. 1 |
| 4,679,340 | 7/1987 | Johansson | 40/322 |
| 4,768,686 | 9/1988 | Storti | 223/92 |
| 4,886,010 | 12/1989 | Stutzman | 116/308 |

FOREIGN PATENT DOCUMENTS

| | | |
|---|---|---|
| 561046 | 5/1960 | Belgium . |
| 2055571 | 3/1981 | United Kingdom . |

OTHER PUBLICATIONS

"The An'ser—How to tie class knots & Instructions for attaching the An'ser" product brochure.

*Primary Examiner*—C. D. Crowder
*Assistant Examiner*—Bibhu Mohanty
*Attorney, Agent, or Firm*—Palmatier, Sjoquist & Helget

[57] ABSTRACT

A hanger valet for storing clothing accessories such as ties, belts, braces, and jewelry such as cufflinks on the same hanger with a given suit, thus allowing coordination of the accessories with the suit. The hanger valet comprises a suit hanger, a valet portion with a number of tie keepers, belt/brace keepers, and jewelry holders, a numerical system for indicating the week of the month in which to wear a tie, a moving indicator of which tie was last worn, and an aromatic cedar block.

4 Claims, 3 Drawing Sheets

HANGER VALET

BACKGROUND OF THE INVENTION

The present invention relates generally to the field of clothing accessory hangers and the like, and more particularly, to an improved hanger valet.

In the ever increasingly competitive business world, it is as important as ever for one to look his best. Accessories such as ties, belts, cufflinks, etc. are an integral part of the business wardrobe, and people have made heavy investments in such items. Because of this, a need has arisen for a device which can protect these items and assist the owner in coordinating his or her clothing accessories with various wardrobes. Such a device is called a hanger valet.

To be most useful, a hanger valet should be able to securely hold a number of neckties as well as one or more belts or braces, so that these items will not slip off the hanger valet during travel and thus become wrinkled or dirty. The hanger valet should also have a means for securely holding jewelry such as cufflinks.

A hanger valet should also be constructed of one piece with the hanger itself, so as to be sturdy and to prevent the valet portion from separating from the hanger portion during use. In order to maximize closet space, the hanger valet should be of approximately the same size as a standard suit hanger.

The hanger portion of the valet should be constructed in such a way as to hold a suit jacket with minimal distortion of the jacket's shoulders.

The primary function of a hanger valet is to coordinate the various accessories (ties, belts, jewelry, etc.) with a given suit. It is especially important to coordinate the ties with the suit, as a mismatched suit and tie has severe visual impact. Because the hanger valet will hold a number of ties, it is important to provide an indication of which tie was most recently worn, thereby minimizing wear on the ties and providing maximum visual variety in the wardrobe.

The hanger valet should also have a system for keeping track of which week of the month to wear a particular tie during rotation of the suit. To be usable to the visually impaired or blind person, such indicia should also be provided in Braille.

SUMMARY OF THE INVENTION

A hanger valet for storing clothing accessories such as ties, belts, braces, and jewelry such as cufflinks on the same hanger with a given suit, thus allowing coordination of the accessories with the suit. The hanger valet comprises a suit hanger, a valet portion with a number of tie keepers, belt/brace keepers, and jewelry holders, a numerical system for indicating the week of the month in which to wear a tie, a moving indicator of which tie was last worn, and an aromatic cedar block.

An object and advantage of the present invention is that it provides secure storage for several neckties, one or more belts or braces, and jewelry such as cufflinks. These accessories will not slip off the hanger valet during travel.

Another object and advantage of the present invention is that the tie keepers are raised above the body of the valet for easy access.

Another object and advantage of the present invention is that it is of one piece construction, that is, the hanger portion and valet portion are manufactured as one piece, thereby preventing the valet portion from becoming separated from the hanger portion during use.

Another object and advantage of the present invention is that is of approximately the same size as a standard suit hanger, thereby maximizing closet space.

Another object and advantage of the present invention is that the hanger portion includes a suit hanger with substantially broader shoulders than other hangers, thus reducing distortion to the shoulders of the suit.

Still another object and advantage of the present invention is that it provides moving indicia of which tie was most recently worn, thereby allowing the owner to avoid wearing the same tie two times in a row and minimizing wear on the ties.

Another object and advantage of the present invention is that it provides a numerical system indicating the week of the month to wear a particular tie.

Another object and advantage of the present invention is that the numerical system is provided both in standard arabic numerals and in Braille, thus making it possible for a visually impaired or blind person to select a particular tie.

Another object and advantage of the present invention is that it includes an aromatic cedar block, which absorbs odor and moisture and prevents insect/moth nesting during seasonal storage.

Another object/advantage of the present invention is that it has a location for affixing a store advertising label or other advertising medium, such as silk screening.

Another object/advantage of the present invention is that is has a location for affixing a garment identification label so that the garment may be returned to that particular hanger after cleaning.

Another object/advantage of the present invention is that each tie keeper has a location for affixing a label indicating the proper shirt for rotation of that particular tie.

BRIEF DESCRIPTION OF THE DRAWINGS

FIG. 2 is a top perspective view of the hanger valet.

DETAILED DESCRIPTION OF THE PREFERRED EMBODIMENTS

Figure 1:
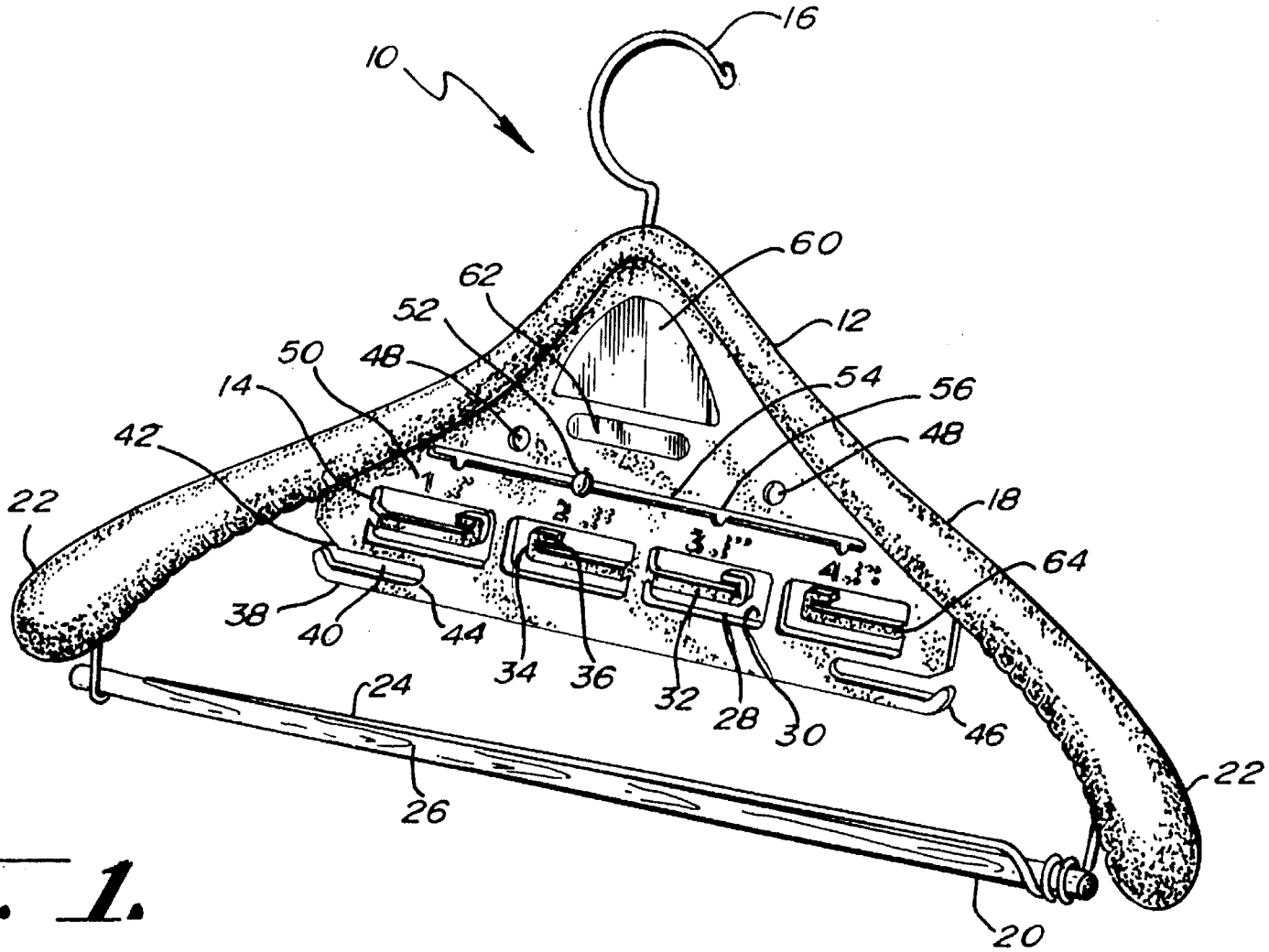
FIG. 1 is a front perspective view of the hanger valet.
Figure 5:
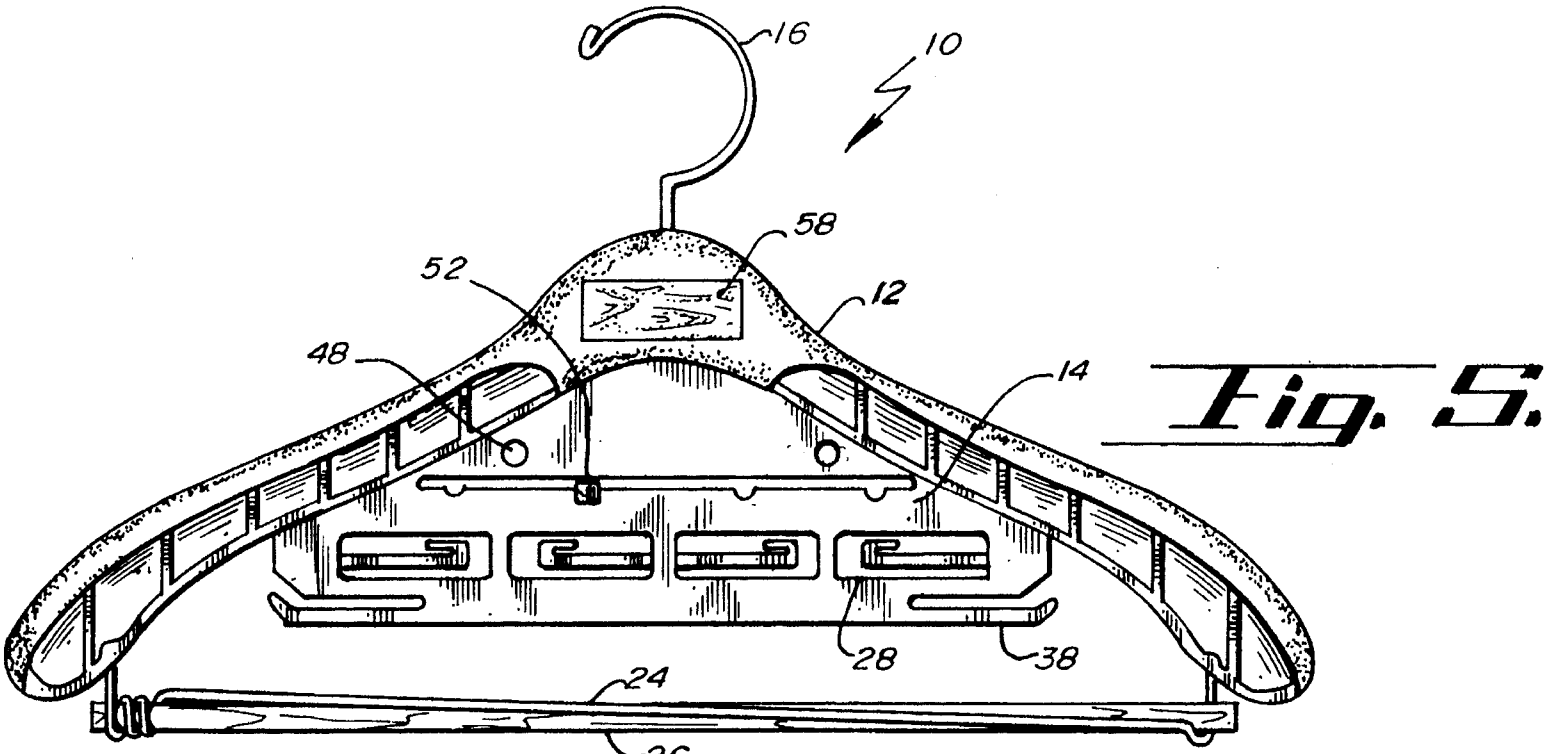
FIG. 5 is a rear perspective view of the hanger valet.
Figure 8:
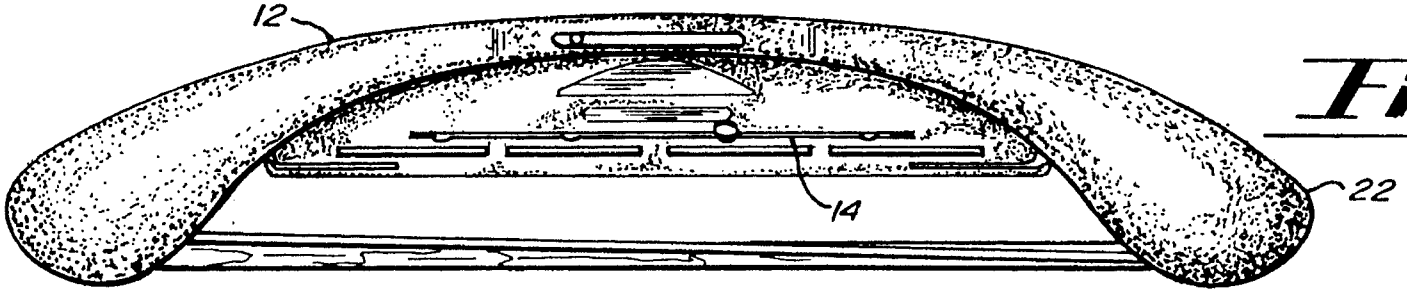
Figure 3:
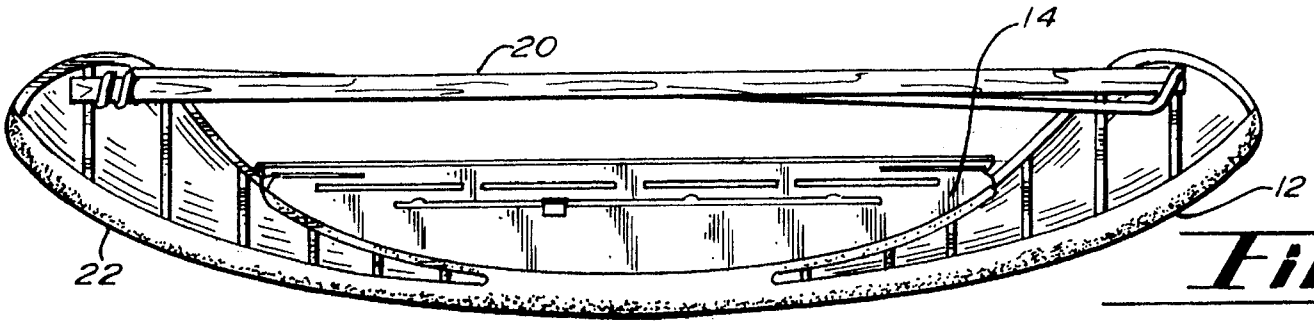
FIG. 3 is a bottom perspective view of the hanger valet.
Figure 4:
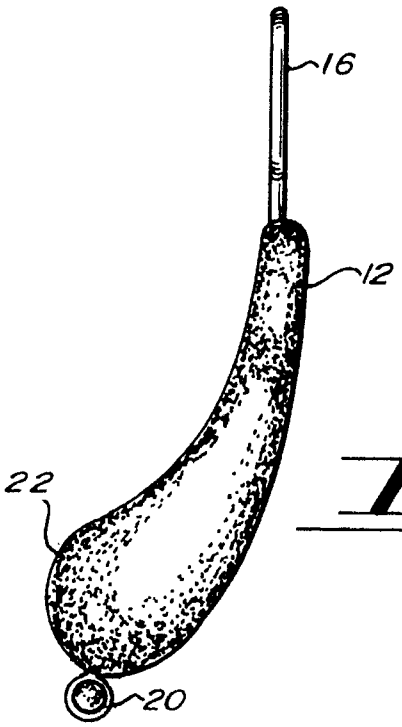
FIG. 4 is a side elevation view of the hanger valet.

The hanger valet of the present invention is shown generally as the number 10 in the Figures. The hanger valet 10 includes a hanger portion 12 and a valet portion 14. In one preferred embodiment, the hanger portion 12 and the valet portion 14 are integrally constructed of a single piece. Thus, the valet portion 14 cannot become separated from the hanger portion 12 during storage or travel. However, the valet portion 14 may also be separate and attached to the hanger portion 12 by suitable means, such as adhesive.

The hanger valet 10 is of approximately the same size as a standard suit hanger, thus not taking up any more closet space than a standard suit hanger.

The hanger portion 12 further includes a hook portion 16 for hanging the hanger valet to a closet rod or garment bag, a suit jacket hanger 18, and a trousers hanger 20.

The suit jacket hanger 18 is improved over existing suit hangers in that the shoulder portions 22 are much larger than is typical of such devices. In the preferred embodiment, the shoulder portions 22 are about 2¼ inches in diameter, as opposed to about ⅝ inch in other hangers. These enlarged shoulder portions 22 provide better pad shape and support for the shoulders of a suit jacket, thus reducing distortion to the shoulders of the suit jacket.

The trousers hanger 20 is of a standard type, with a substantially horizontal support 24 upon which the trousers are folded, and a rod 26 attached to the support 24. The trousers are clamped between the support 24 and the rod 26.

The valet portion 14 includes a number of tie keepers 28 for securely holding neckties in place on the valet portion 14. In the preferred embodiment, the tie keepers 28 are arranged substantially in line horizontally across the valet portion 14. Each tie keeper 28 comprises an aperture 30 through the valet portion 14, a bar portion 32 which partially bisects the aperture 30, and a retainer portion 34 connected to the bar portion 32 and which forms with the bar portion a recess 36 in which the tie is locked in place. In the preferred embodiment, the bar portion 32 and retainer portion 34 are raised above the surface of the valet portion 14, thereby allowing easy insertion of a tie into the tie keeper 28.

The valet portion 14 also includes one or more belt/brace keepers 38 for securely holding a belt or a pair of braces (suspenders). The belt/brace keeper 38 consists of a slot 40 with an open end 42 on the periphery of the valet portion 14, and with a closed end 44 away from the periphery of the valet portion 14. The open end 42 is partially obstructed by an upturned lip 46 which prevents the belt or braces from slipping out of the slot 40.

The valet portion 14 also includes one or more jewelry holders 48, which are openings 48 through the valet portion 14 through which the shank portion of a cufflink may be inserted with the end portion of the cufflink in line with the shank. Following insertion, the end portion of the cufflink is twisted perpendicular to the shank so as to lock the cufflink in place in the holder 48.

The valet portion 14 also includes a number 50 adjacent to each tie keeper 28. The number 50 is provided in both arabic numerals and in Braille, so that the visually impaired person may identify the number. The number 50 may be used as an indicator of the week of the month during which to wear a particular tie as the suit is rotated weekly for wearing.

The valet portion 14 also includes a movable indicator 52 associated with the tie keepers 28. In the preferred embodiment, the movable indicator 52 is a stud 52 which slides in a slot 54 parallel to the row of tie keepers 28. The slot 54 has detents 56 above each tie keeper for detenting the stud 52. The indicator 52 may be moved along the slot 54 into a detent 56 above the last tie worn, so that the owner can avoid wearing that tie more than once in a row, thus reducing wear on the tie and providing a varied appearance to others. The movable indicator supplements the numbers 50 by allowing more frequent wear than once a week and by allowing the ties to be worn in any order.

The valet portion 14 also includes an aromatic cedar block 58 mounted on the back side of the hanger portion 12. The cedar block absorbs odor and moisture and prevents insect/moth nesting during seasonal storage.

The valet portion 14 also includes an area 60 for attaching a store advertising label and an area 62 for attaching a garment identification label. A corresponding garment identification label may be attached to a suit so that the suit is returned to the correct hanger valet 10 after use.

Each tie keeper 28 includes an area 64 for attaching a shirt identification label. A corresponding label may be attached to a shirt so that the shirt is always worn with the tie associated with that particular tie keeper 28.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A hanger valet for suits and accessories, comprising:

a hanger portion for hanging a suit, wherein said hanger portion further comprises:

a hook portion for hanging the hanger valet to a closet rod or garment bag, a suit jacket hanger having enlarged shoulder supports, and a trousers hanger, wherein said trousers hanger further comprises a substantially horizontal support and a rod attached to said support adapted to clasp the suit trousers between the rod and the support, a valet portion for attaching accessories, said hanger portion and said valet portion being integrally constructed as a single piece, and a plurality of tie keepers wherein each said tie keeper further comprises:

an aperture through said valet portion, a bar portion partially bisecting said aperture, and a retainer portion connected to said bar portion and forming with said bar portion a recess for locking a tie in place on said tie keeper and a movable indicator associated with said tie keepers, wherein said movable indicator is movable in a slot parallel to said tie keepers and said movable indicator is detented adjacent to each tie keeper.

2. A hanger valet as in claim 1, wherein said bar portion and said retainer portion are in a different plane from said aperture.

3. A hanger valet for suits and accessories, comprising:

a hanger portion for hanging a suit, with a suit jacket hanger having enlarged shoulder supports, and a trousers hanger, and a valet portion for attaching accessories, further comprising:

a plurality of tie keepers, each said tie keeper comprising an aperture through said valet portion, a bar portion bisecting said aperture, and a retainer portion connected to said bar portion and forming with said bar portion a recess for locking a tie in place on said tie keeper, said bar portion and said retainer portion being in a different plane from said aperture, said tie keepers being arranged substantially in line horizontally across said valet portion, numbers adjacent to said tie keepers, in both arabic form and Braille, a movable indicator associated with said tie keepers, wherein said movable indicator is movable in a slot parallel to said tie keepers and said movable indicator is detented adjacent to each tie keeper, a belt/braces keeper, said belt/braces keeper further comprising a slot with an open end and a closed end, the open end being partially obstructed so as to prevent the belt or braces from easily slipping out of the slot, a jewelry holder, further comprising an opening through said valet portion adapted to engage the shank of a cufflink, an aromatic cedar block, an area for affixing a store advertising label or other advertising medium, such as silk screening, an area for affixing a garment identification label so that the garment may be returned to that particular hanger after use, and said tie keeper having an area for affixing a label indicating the proper shirt for rotation of that particular tie.

4. A hanger valet as in claim 3, wherein said hanger portion and said valet portion are integrally constructed as a single piece.

* * * * *